US005291816A

United States Patent [19]

Adams

[11] Patent Number: 5,291,816

[45] Date of Patent: Mar. 8, 1994

[54] HARNESS FOR GUITAR OR LIKE INSTRUMENT

[76] Inventor: Cliff Adams, 6885 Shepard Mesa Rd., Carpinteria, Calif. 93013

[21] Appl. No.: 65,651

[22] Filed: Jul. 9, 1993

[51] Int. Cl.[5] ..... G10D 3/00; G10G 5/00

[52] U.S. Cl. ..... 84/327; 224/257; 224/272

[58] Field of Search ..... 84/327; 224/910, 204, 224/257, 272, 258

[56] References Cited

U.S. PATENT DOCUMENTS

| | | | |
|---|---|---|---|
| 4,254,901 | 3/1981 | McIntosh | 224/258 |
| 4,279,367 | 7/1981 | Jacobs | 224/257 |
| 4,930,695 | 6/1990 | Thompson | 224/257 |
| 5,016,797 | 5/1991 | Rowledge | 224/257 |
| 5,069,103 | 12/1991 | Healy | 84/327 |

*Primary Examiner*—Michael L. Gellner

*Assistant Examiner*—Cassandra C. Spyrou

[57] ABSTRACT

A harness that positions and stablizes a guitar or like instrument on a wearer. The harness utilizes three length-adjustable segments connected together at one end of each of the segments. The connection of the three segments is located behind the back of the wearer and the opposite end of each segment is structured for attachment to the anchor points on the guitar or like instrument. One segment goes up over the right shoulder and down across the torso and attaches to one of the instrument anchor points. A second segment wraps under the left arm and attaches to the same instrument anchor point. A third segment wraps under the right arm, diagonally downward and attaches to the second instrument anchor point. The length of each segment is adjusted to vary the position and stability of the instrument.

1 Claim, 2 Drawing Sheets

HARNESS FOR GUITAR OR LIKE INSTRUMENT

BACKGROUND OF THE INVENTION

1. Field Of Invention

This invention pertains to the field of stringed musical instruments. More specifically, it pertains to devices for positioning and stabilizing a guitar or like instrument during playing.

2. Prior Art

Guitars and like instruments are often played while standing with the instrument in front of the player's torso. For definiteness, explicit reference to guitars used throughout this specification shall be understood to be guitars and like instruments. These instruments are almost universally supplied with two anchor points, one at each end of its body in a line generally parallel to the neck of the instrument.

Prior art devices for positioning and stabilizing a guitar generally consist of a single or double strap connected to the two anchor points that transfers most or all of the weight of the instrument to the shoulder of the hand used for fretting. The fretting hand is positioned along the entire length of the instrument neck while performing its function of clamping the strings of the instrument against the neck of the instrument, and is thus, generally considered to have a more demanding role than the other, the strumming, hand. Prior art devices also allow the instrument to slip around and flop away from the torso of the wearer. Thus the fretting hand is required to provide some of the support and most of the stability for the instrument.

Although these burdens to the shoulder, the arm, and the hand involved in fretting is fatiquing and impedes performance, it has generally been accepted as unavoidable.

SUMMARY OF THE INVENTION

The present invention provides a guitar harness that alleviates the above-mentioned fatiquing and impeding burdens.

The weight of the instrument is distributed to the shoulder through a shoulder segment passing over the shoulder opposite the fretting hand and to the torso through a torso segment passing under the arm of the fretting hand. The shoulder segment and the torso segment are attached to one anchor point on the guitar and the opposite end of each segment is connected at the back of the wearer opposite the same guitar anchor point to a lower segment. The opposite end of the lower segment is attached to a second guitar anchor point by wrapping diagonally downward under the opposite arm involved in fretting the instrument.

The three segments, shoulder segment, torso segment, and lower segment, are each length-adjustable and when properly adjusted accomplish position and stability by locating the guitar relative to and pulling it against the torso.

Thus the present invention relieves the fretting hand and its arm and shoulder from the role of positioning and stabilizing the instrument.

Futher objects and advantages of the present invention will become apparent from a consideration of the drawings and ensuing description.

REFERENCE NUMERALS AND NOMENCLATURE IN DRAWINGS

10: Harness of the Present Invention
20: Torso Segment
21: Torso Strap
25: Attachment Method
28: Attachment Means
30: Lower Segment
31: Lower Strap
33: Adjustment Means
34: Reinforcement
35: Attachment Method
36: Attachment Technique
37: Adaptor
38: Attachment Means
40: Shoulder Segment
41: Shoulder Strap
45: Attachment Method
48: Attachment Means
50: Backpiece
60: Player
62: Left Hand (Fretting Hand)
63: Left Arm
64: Left Shoulder
65: Torso
66: Right Shoulder
67: Right Arm
68: Right Hand (Strumming Hand)
69: Back
70: Guitar
72: Body
74: Neck
76: Strings
78: Upper Anchor Point
79: Lower Anchor Point
80: Standing Surface

DETAILED DESCRIPTION OF THE PREFERRED EMBODIMENT

The present invention is a harness worn by a player to position and stabilize a stringed musical instrument such as a guitar, mandolin, or ukelele while playing and typically standing. For the detailed description that follows, as well as all descriptions and drawings throughout this entire specification, it should be noted that the configuration is referring to a right-handed player, and appropriate opposites are assumed to be understood for a left-handed player. It should also be noted that like elements are identified by like numbers and like nomenclature throughout this specification and its four drawing figures.

Figure 1:
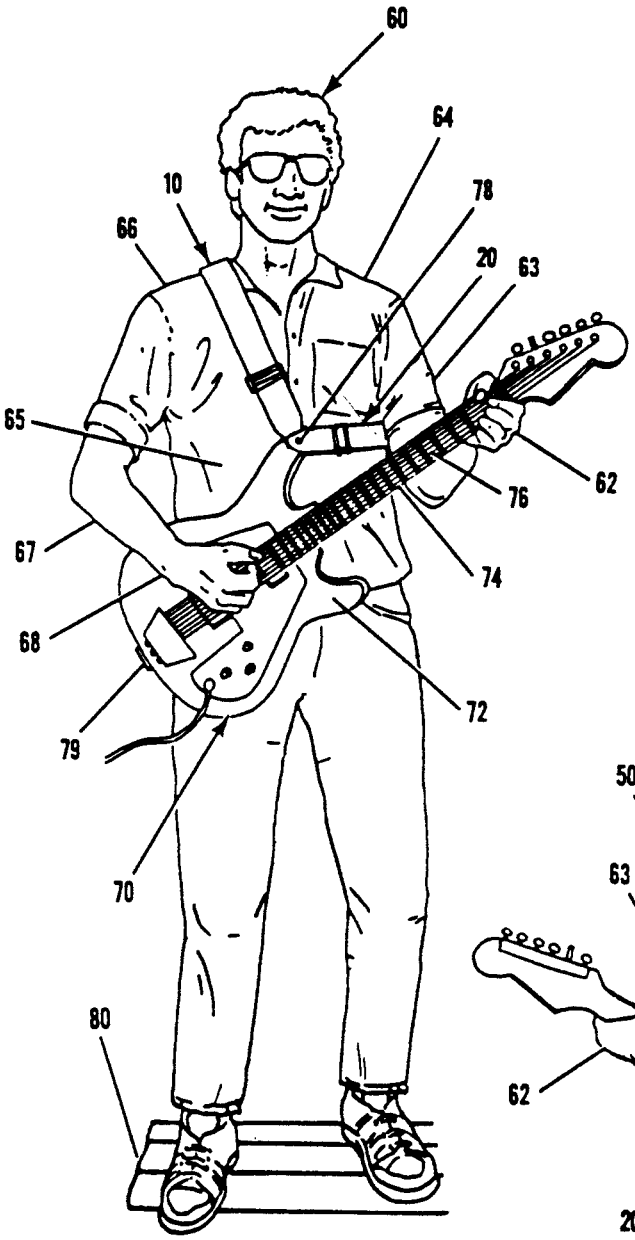
FIG. 1 is a front perspective view of a player using the guitar harness of the present invention.

FIG. 1 is a front perspective view of a player 60 playing guitar 70. Guitar 70 includes body 72, neck 74, and strings 76. Guitar 70 is supplied with upper anchor point 78 and lower anchor point 79. Anchor points 78 and 79 are outwardly protruding studs having a broadened head. Player 60 has left hand 62, left arm 63, left shoulder 64, torso 65, right shoulder 66, right arm 67, right shoulder 68, and back 69. Player 60 plays guitar 70 by placing left hand 62, referred to as the fretting hand, at various positions along neck 74 and while clamping strings 76 against neck 74, strums or plucks strings 76 with right hand 64, referred to as the strumming or plucking hand. Player 60 is wearing present invention harness 10 to position and stabilize guitar 70.

Figure 2:
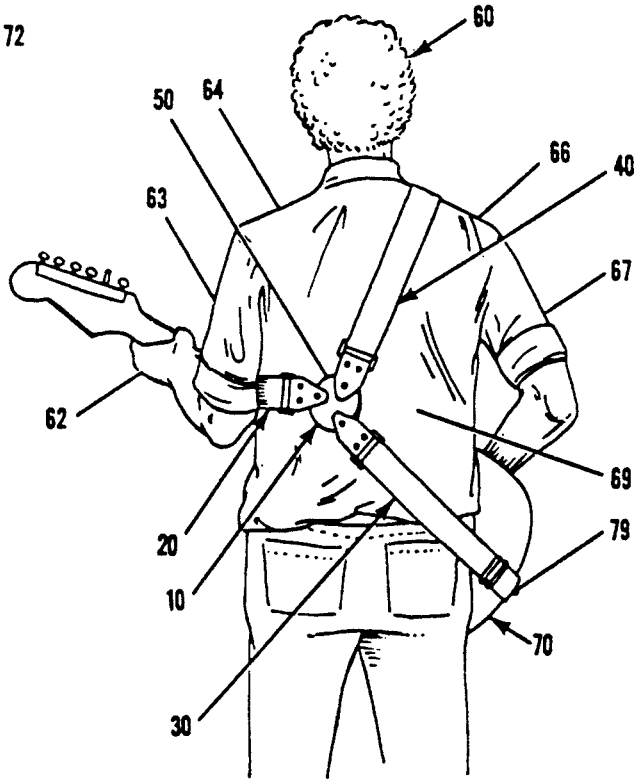
FIG. 2 is a rear perspective view of a player using the guitar harness of the present invention.

FIG. 2 is a rear perspective view of player 60 using present invention harness 10.

Figures 3, 4:
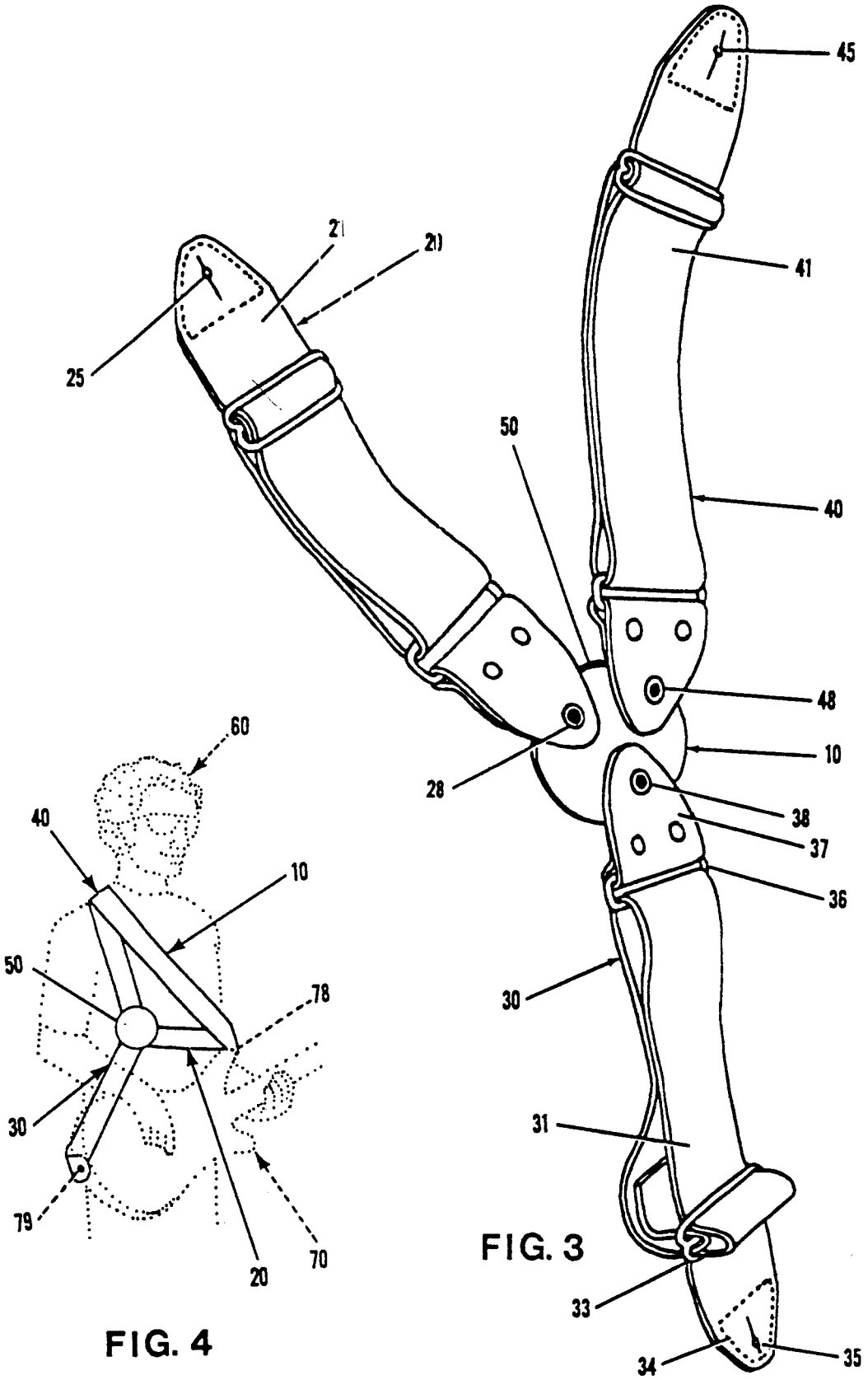
FIG. 3 is a detailed perspective view of the present invention.
FIG. 4 is a side perspective view of a player using the guitar harness of the present invention, with guitar and player in phantom.

FIG. 3 shows a perspective view of present invention harness 10. Harness 10 comprises a torso segment 20, a lower segment 30, and a shoulder segment 40. Segments 20, 30, and 40 are connected to a backpiece 50 by attachment means 28, 38, and 48, respectively, that allow for angular rotation within the plane of backpiece 50.

In the preferred embodiment, attachment means 28, 38, and 48 is a simple rivet connecting each segment 20, 30, and 40, respectively, to backpiece 50 thus allowing free rotation. Means 28, 38, and 48 may vary widely in configuration and relative locations. One embodiment would place means 28, 38, and 48 coincident on backpiece 50, thus reducing the need for backpiece 50 and requiring a single rivet instead of three as in the preferred embodiment.

Segments 20, 30, and 40 are constructed identically, varying only in length as required by player 60. The lower segment 30 is shown in FIG. 3 as an exaggerated view for ease of visualization.

Lower strap 31 can be made from various materials. Strength is required but flexibility and suppleness are desired qualities. Leather with the approximate dimensions of 5.0 centimeters (2 inches) wide, 0.16 centimeters (1/16 inch) thick, and 1 meter (3.3 feet) long is a suitable material. One end of strap 31 is strengthened with a reinforcement 34 such as leather, plastic, fabric, or similar material and configured with attachment method 35 such as an eyelet for attachment to anchor point 79. The opposite end of strap 31 can have a varity of configurations depending on attachment means 38. In the preferred embodiment, strap 31 passes through both sides of adjustment means 33, a double rectangular bracket, through attachment technique 36, a rectangular bracket, again through both sides of means 33, and is glued, sown, or in some manner affixed to itself.

Lower segment 30 adjustment, that is the distance between attachment method 35 and attachment means 38 can be varied by sliding adjustment means 33 along strap 31.

Adaptor 37 is looped through means 36, doubled back and glued, sown, or in some manner affixed to itself. Adaptor 37 is configured with attachment means 38. Adaptor 37 can be made from a varity of materials. Leather approximately 0.2 centimeters (0.08 inches) thick is suitable.

Torso segment 20 and shoulder segment 40 are fabricated in the same manner as lower segment 30, the exception being torso strap 21 of segment 20 is approximately 0.6 meters (2 feet) long and shoulder strap 41 of segment 40 is approximately 1.1 meters (3.62 feet) long. Strap 21 and strap 41 are configured with attachment method 25 and 45, respectively.

Backpiece 50 can take numerous configurations and be made from numerous materials depending on attachment means 28, 38, and 48. In the preferred embodiment, backpiece 50 is a 0.38 centimeter (0.15 inch) thick leather disc, 7.6 centimeters (3 inches) in diameter.

FIG. 4 is a perspective side view of player 60 using present invention harness 10 to position and stabilize guitar 70. Player 60 and guitar 70 are shown in phantom. Player 60 must first determine where guitar 70 is to be positioned relative to torso 65. Guitar 70 position is generally restricted to the left side of torso 65 and in variations off standing surface 80. Once determined, backpiece 50 is positioned behind back 69 of player, at the same elevation off standing surface 80 and on the same side of torso 65 as upper anchor point 78. Segments 20, 30, and 40 rotate to accommodate a wide varity of guitar 70 positions. Shoulder segment 40 is passed over right shoulder 66 and down across torso 65 and attached to anchor point 78 by method 45. Torso segment 20, while remaining parallel to surface 80, is wrapped under left arm 63 and attached to anchor point 78 by method 25. Lower segment 30 is wrapped diagonally downward under right arm 67 an attached to lower anchor point 79 by method 35. The lengths of segments 20, 30, and 40 are adjusted to maintain position and to pull guitar 70 into torso 65 to the desired stability.

In summary, present invention harness 10 as described and pictured herein can be used by a player to position and stabilize a guitar or like instrument while relieving left hand 62, left arm 63, and left shoulder 64 from the role of positioning and stabilizing the instrument. Thus the player's performance is not encumbered and fatique is alleviated. The invention has some subtle advantages as well, such as ease of manufacturing, some right shoulder-to-torso weight distribution control, and ease of getting harness 10 on and off, which can be done by simply attaching torso segment 20 to or taking it off upper anchor point 78.

While the harness 10 described and pictured is the preferred embodiment of the invention, various modifications, alternative construction techniques, and equivalents may be employed without departing from the true spirit or scope of the invention. For example, if straps 21, 31, and 41 were approximately two and a half centimeters (1 inch) or less wide, they could pass directly through curved slots in backpiece 50 thereby eliminating several components and operations thus retaining the rotational requirement within the plane of backpiece 50 and remaining within the intent and scope of the invention. Thus it should be understood that the preferred embodiment is meant as example only and not be taken as limiting the scope of my invention, which is defined by the appended claim.

I claim:

1. A harness for positioning and stabilizing a musical stringed instrument comprising:

a discus backpiece;

a first segment having a first and second end; a first attachment means for rotationally attaching said first end of said first segment to said backpiece; a first anchoring means for anchoring said second end of said first segment to said instrument;

a second segment having a first and second end; a second attachment means for rotationally attaching said first end of said second segment to said backpiece; a second anchoring means for anchoring said second end of said second segment to said instrument;

a third segment having a first and a second end; a third attachment means for rotationally attaching said first end of said third segment to said backpiece; a third anchoring means for anchoring said second end of said third segment to said instrument.

* * * * *